United States Patent [19]

Knippenberg et al.

[11] 4,208,449

[45] Jun. 17, 1980

[54] METHOD OF MAKING AN ELECTRIC RESISTOR HAVING A RESISTANCE BODY CONSISTING OF SILICON CARBIDE HAVING A NEGATIVE TEMPERATURE COEFFICIENT

[75] Inventors: Wilhelmus F. Knippenberg; Gerrit Verspui; Siegfried H. Hagen, all of Eindhoven, Netherlands

[73] Assignee: U.S. Philips Corporation, New York, N.Y.

[21] Appl. No.: 880,507

[22] Filed: Feb. 23, 1978

Related U.S. Application Data

[60] Division of Ser. No. 615,695, Sep. 22, 1975, Pat. No. 4,086,559, and a continuation-in-part of Ser. No. 504,912, Sep. 11, 1974, abandoned.

[51] Int. Cl.[2] ..... B05D 5/12; H01C 7/04

[52] U.S. Cl. ..... 427/101; 427/85; 427/95; 427/249; 338/222; 338/22 SD; 338/308; 148/174; 148/175; 252/516

[58] Field of Search ..... 427/85, 95, 101, 249; 338/20, 21, 22, 306, 307, 308; 148/174, 175; 252/516

[56] References Cited

U.S. PATENT DOCUMENTS 3,157,541 11/1964 Heywang et al. ..... 148/174

*Primary Examiner*—Michael F. Esposito
*Assistant Examiner*—Richard Bueker
*Attorney, Agent, or Firm*—Norman N. Spain

[57] ABSTRACT

A method of making an electric resistor having a negative temperature coefficient of resistance whose resistance body consists of p-type doped pyrolytic polycrystalline cubic silicon carbide.

8 Claims, 2 Drawing Figures

Figure 1:
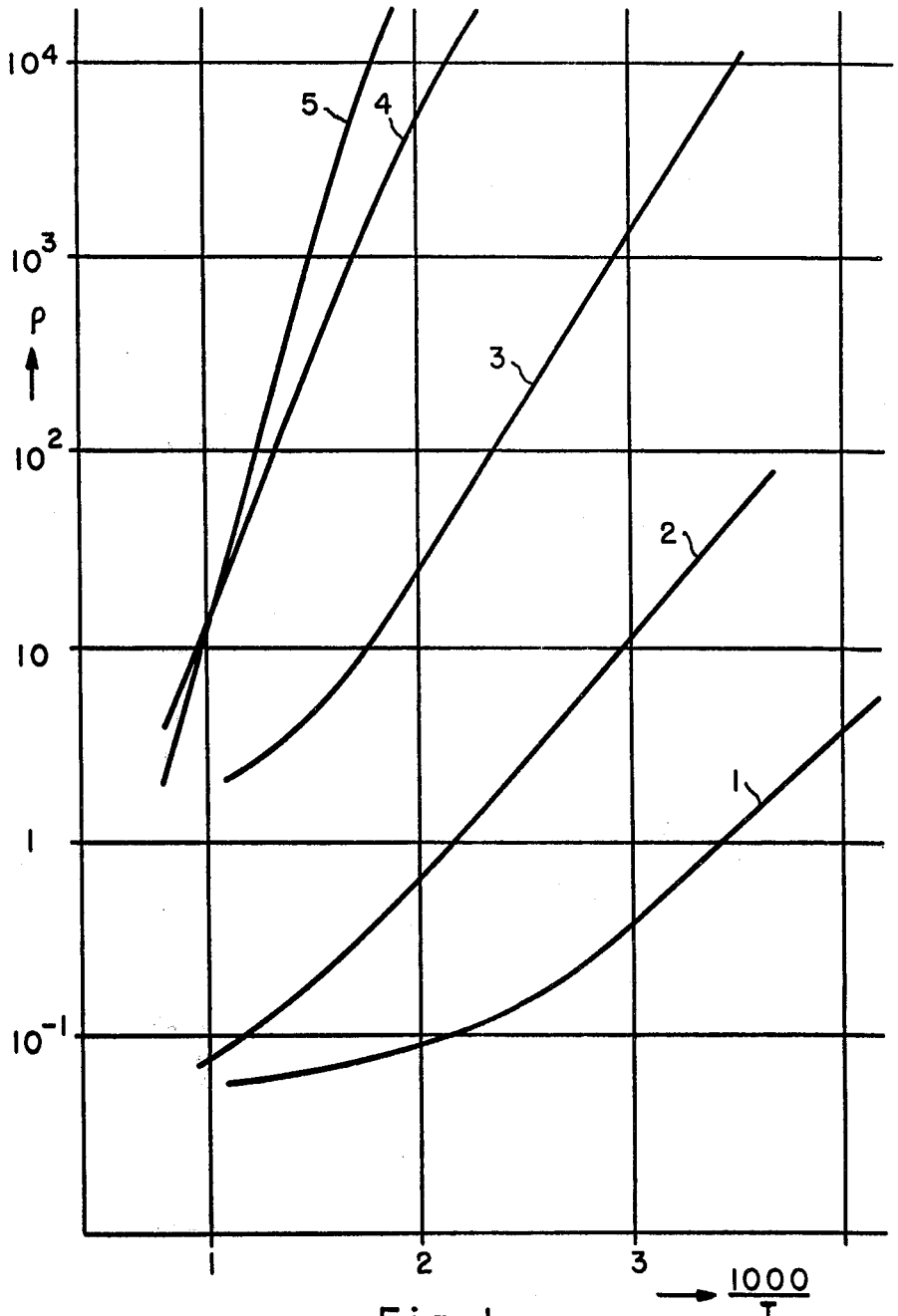

METHOD OF MAKING AN ELECTRIC RESISTOR HAVING A RESISTANCE BODY CONSISTING OF SILICON CARBIDE HAVING A NEGATIVE TEMPERATURE COEFFICIENT

This is a division of application Ser. No. 615,695, filed Sept. 22, 1975 now U.S. Pat. No. 4,086,559.

This application is a continuation-in-part of copending U.S. patent application Ser. No. 504,912, filed Sept. 11, 1974 and now abandoned.

The invention relates to electric resistors having a resistance body consisting of doped polycrystalline silicon carbide having a negative temperature coefficient, so called N.T.C.-resistor and to a method of manufacturing resistance bodies of such electric resistors.

Electric resistors based on doped polycrystalline hexagonal silicon carbide are known. The known resistors are manufactured of silicon carbide obtained by using the so-called Acheson process. In this process a mixture of $SiO_2$ and carbon to which a compound of the doping element, for example, $B_2O_3$ or $Al_2O_3$ has been added is heated to approximately 2500° C. The resultant polycrystalline mass is pulverized, ground and subsequently sieved. By shaping and sintering the powder which may comprise a binder resistance bodies are obtained, which, dependent on the method used (after provision of electrodes), can be used as heating elements or as voltage dependent electric resistors.

It is proposed to use this known method, in which recrystallization occurs, for the manufacture of thermistors (U.S. Pat. No. 2,916,460), in which polycrystalexagonal silicium carbide will be formed.

One of the drawbacks of this method, some of which will be discussed later on, is that resistance bodies with the small dimensions as required for N.T.C. resistors with a quick response can only be manufactured with difficulty. N.T.C. resistors on the base of silicon carbides have also been manufactured from single crystals (U.S. Pat. No. 2,854,364; J. Sc. Inst. 42, 342 (1965) and Netherlands patent application Nos. 6,613,012 and 6,617,544. The manufacture of N.T.C. resistors with small dimensions from single crystals is rather laborious.

The extent of variation in case of an increasing temperature of the resistance of known resistance bodies consisting of doped monocrystalline silicon carbode is dependent inter alia on the ionization energy of the center caused by the incorporation of the doping element. The increase in the electrical conductance with the temperature is mainly determined by this ionization energy: as it is higher the resistance is higher and temperature dependence is stronger, even at a comparatively high temperature.

The activation energy of the electrical conductance of doped material corresponding to the ionization energy of said center is dependent on different factors; inter alia on the nature and concentration of the doping element.

The maximum activation energy of a known monocrystalline boron-doped silicon carbide is 0.39 eV; the maximum energy is 0.27 eV for aluminum-doped monocrystalline silicon carbode.

These activation energies determine the upper limit of the temperature range in which these known B and Al-doped silicon carbide resistors are useful in practice as N.T.C. resistors. This upper limit is approximately 700° C. This temperature is also an upper limit for the utility of N.T.C. resistors on the base of doped polycrystalline hexagonal silicon carbide as known from the already mentioned U.S. Pat. No. 2,916,460.

A N.T.C. resistor based on non-doped polycrystalline cubic silicon carbide for use in the temperature range of approximately 700° C. to approximately 1800° C. is described in Netherlands patent application No. 6,701,216. For use in the range between approximately 700° C. and approximately 1200° C. the non-doped silicon carbide of the resistance body must be very pure. This is difficult to realize in practice. Moreover, such resistors have very high resistances so that their use in practice is very limited.

An object of the invention is to provide electric resistors having resistance bodies consisting of silicon carbide which are suitable for use as N.T.C. resistors both in a temperature range below and above 700° C., namely in the entire temperature range between approximately 0° C. and approximately 1800° C.

A further object of the invention is to manufacture in a simple manner resistance bodies consisting of doped polycrystalline cubic silicon carbide which may be used for the manufacture of N.T.C.—resistors of small dimensions.

The invention relates to an electric resistor having a resistance body consisting of doped polycrystalline silicon carbide and is characterized in that the resistance body consists of p-type doped pyrolytic polycrystalline cubic silicon carbide.

A body of pyrolytic polycrystalline cubic silicon carbide may be manufactured while using a known pyrolysis process for providing polycrystalline silicon carbide on a support (see Appl. Phys. Letters, Vol. 9, No. 1, pages 37–39).

According to the invention a method is used in which a high melting point support is clad with a coating of a doped polycrystalline cubic silicon carbide by passing a mixture of gases comprising a gaseous silicon compound and a gaseous carbon compound or a gaseous silicon carbon compound and also a gaseous compound of a doping element along a support heated to such a temperature that pyrolysis of the said gaseous compounds is effected under deposition of doped polycrystalline cubic silicon carbide on the support and is characterized in that only a compound of an element producing a p-doping is used as a compound of the doping element.

In the method according to the invention a coating of doped polycrystalline cubic silicon carbide is provided on a support which coating entirely exhibits p-type conductivity in that only a compound of an element giving a p-doping is used during provision of the coating.

The provision of a coating of polycrystalline cubic silicon carbide on a support by pyrolysis on the hot support is a known process. Frequently used as silicon-carbon-containing compounds in this process are alkylchlorosilanes, for example, methyltrichlorosilane in hydrogen having a pressure of 1 atmosphere. The temperature of the support is generally chosen to be between 1000° C. and 2000° C. Heating of the support may be effected directly or indirectly, for example, inductively or by the passage of current or by irradiation.

Suitable as high melting point support material are, for example, tungsten, molybdenum, carbon, aluminum oxide or zirconium oxide. A support may entirely consist of such a material or of an article coated with one of these materials, for example, a carbon coated article consisting of aluminum oxide.

Preferably a wire or tape, in particular a wire is used as a support. With a wire as a support it is possible to obtain products from which N.T.C. resistors having small or very small dimensions can be manufactured. These elements possess a great sensitivity because of their low thermal capacity and low inertia.

A compound of boron, aluminum or beryllium, for example, boronhydride $B_2H_6$, $AlCl_3$, or $BeCl_2$ is used as a compound of a doping element giving a p-doping.

It was found that the electrical resistance and also the activation energy and consequently the resistance and the electrical behaviour of an electric resistor according to the invention exhibited in more than one aspect a different dependence on the concentration of the doping element in the silicon carbide coating than might be expected. This is apparent inter alia from the following.

As compared with the known electric resistors having resistance bodies of doped mono or polycrystalline silicon carbide, an electric resistor according to the invention exhibits an unusual behaviour in various aspects. This becomes manifest inter alia in the following:

the activation energy and the electrical resistance increase with an increasing content of doping element to a maximum value and then decrease;

the activation energy and the specific electrical resistance are considerably higher than those of the known electric resistors based on doped monocrystalline or polycrystalline hexagonal silicon carbide.

Another unexpected new effect of the method according to the invention becomes manifest in that the activation energy of the resistor is dependent on the pyrolysis temperature upon provision of the coating of doped pyrolytic polycrystalline cubic silicon carbide on the understanding that polycrystalline silicon carbide having a higher activation energy is obtained when using a higher pyrolysis temperature.

The invention will be described in greater detail with reference to the accompanying drawing and the following examples.

FIG. 1 of the drawing is a graph showing the relation between specific resistance and temperature of N.T.C.—resistors some of which are according to the invention and some of which are not. ($\rho$ in ohm cm, temperature in degrees Kelvin).

Figure 2:
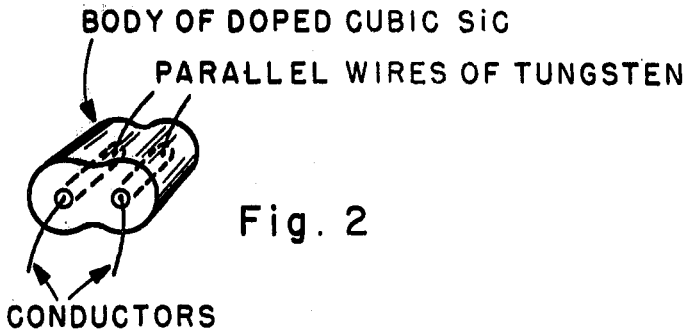

FIG. 2 of the drawing shows a resistor made according to the method of the invention.

In various tests a tungsten wire of 0.2 mm cross-section was provided in a quartz glass bell jar (diameter 10 cm, length 50 cm). The W-wire was secured to carbon electrodes and exposed to the pyrolysis gas over a length of 30 cm. The wire was heated by direct passage of current to approximately 1250° C. A gas mixture consisting of hydrogen, methyltrichlorosilane ($SiCl_3.CH_3$) and boron hydride ($B_2H_6$) was passed through the bell jar for 12 minutes. Flow rate: 2 l/min. The concentration of methyltrichlorosilane was 15% by volume. In all tests a 300 $\mu$m thick coating of compact p-doped polycrystalline cubic silicon carbide was obtained.

The wire coated with the 300 $\mu$m thick coating of silicon carbide was divided in pieces. Of the pieces resistors were made by providing their ends on the outer surfaces with electrodes over a length of 3.0 mm by means of a gold tantalum alloy (99% Au, 1% Ta).

Such resistors were made of samples obtained in different pyrolysis tests. (In the pyrolysis tests all circumstances were the same with the exception of the concentration of boron hydride). Resistance measurements were performed on the resistors obtained.

Table I shows the relationship between the concentration of boron hydride used in the pyrolysis gas (column 1), the measured resistances (column 3) and the activation energy at 650° C. (column 2) (calculated in known manner from the dependence of the electrical resistance on the temperature of the resistance body of the electric resistor (see also FIG. 1)).

Table I

| concentration of boron hydride (in % by volume) | Activation energy (in eV.) | Electrical resistance (in Ω cm at 25° C.) |
|---|---|---|
| $9.10^{-3}$ | 0.36 | $2.10^4$ |
| $2.10^{-2}$ | 0.50 | $5.10^5$ |
| $9.10^{-2}$ | 0.56 | $6.10^5$ |
| $5.10^{-1}$ | 0.50 | $9.10^4$ |
| $9.10^{-1}$ | 0.10 | 4.0 |

These results show in which way one of the previously mentioned parameters with which the properties of the electric resistors according to the invention are adjustable influence the resistance values and the activation energies of the resistors, namely the concentration of the compound of the doping element (in this case $B_2H_6$) in the pyrolysis gas and consequently the concentration of the doping element (in this case B) in the coating of pyrolytic polycrystalline cubic silicon carbide. In case of an increasing concentration of $B_2H_6$ in the pyrolysis gas the electrical resistance and also the activation energy initially increase and then decrease.

Furthermore Table I shows that satisfactory or very satisfactory N.T.C. resistors can be obtained when using approximately $5.10^{-3}$% by volume to approximately $7.10^{-1}$% by volume of $B_2H_6$ in the pyrolysis gas at the pyrolysis temperature chosen (approximately 1250° C.). This was found to be the case in the temperature region of approximately 1200° C. to approximately 1350° C.

In case of a higher temperature the range of concentrations of $B_2H_6$ in the pyrolysis gas with which electric resistors can be obtained which have the previously mentioned unusual behaviour is smaller. From approximately 1350° C. to approximately 1500° C. this range is, for example, between approximately $2.10^{-3}$% by volume and approximately $5.10^{-2}$% by volume. As previously mentioned such resistors have higher activation energies.

Curves 3, 4 and 5 relate to electric resistors according to the invention; curves 1 and 2 are given for comparison.

Curve 1 relates to an electric resistor having a single crystal of Al-doped hexagonal SiC (Al-concentration: 0.025% by weight) as a resistance body; curve 2 relates to an electric resistor having a single crystal of B-doped hexagonal SiC (B concentration: 0.03% by weight) as a resistance body.

Curve 3 relates to an electric resistor according to the invention having a resistance body of Al-doped pyrolytic polycrystalline cubic silicon carbide. In the manufacture of the resistance body the pyrolysis temperature was 1200° C., the concentration of the compound of the doping element ($AlCl_3$) was 0.01% by volume in the pyrolysis gas (hydrogen of 1 atmosphere with 15% by volume of $SiCl_3.CH_3$).

Curves 4 and 5 relate to electric resistors according to the invention having resistance bodies of B-doped pyrolytic polycrystalline cubic silicon carbide. In the manufacture of the resistance body of curve 4 the pyrolysis temperature was 1200° C. and the concentration of $B_2H_6$ in the pyrolysis gas was 0.04% by volume; for curve 5 they were 1400° C. and 0.007% by volume, respectively.

The figure clearly shows the much greater dependence of the electrical resistance on temperature of the electric resistors according to the invention (curves 3, 4 and 5) than of the known electric resistors (curves 1 and 2).

The figure also shows that the B-doped electric resistor has a greater temperature dependence than the Al-doped electric resistor according to the invention (and that for the first-mentioned resistor the activation energy is larger than for the latter—as is apparent from the steeper slope of the curves for B-doped electric resistors). Futhermore it can be seen that when comparing curves 5 and 4 resistors are obtained at a higher pyrolysis temperature with a greater temperature dependence of the electrical resistance (larger activation energy).

When using a compound of aluminum as a doping element at pyrolysis temperatures of about 1200° to about 1500° C. concentrations of this compound of between 0.002 and 0.7% by volume are preferably used in the pyrolysis gas.

The Al-doped polycrystalline cubic silicon carbide obtained by the method according to the invention has specific resistances of $10^3$–$10^4$ Ohm cms. (activation energy from 0.3 to 0.4 eV).

Each % by volume of a compound of one of the doping elements Al or B in the pyrolysis gas results in content of about 1% by weight of the respective doping element in the SiC coating at a pyrolysis temperature of about 1200° C. At a pyrolysis temperature of about 1400° C. each percent by volume results in a content of 0.003% by weight. At temperatures between the mentioned ones values of the contents between the mentioned ones are found.

The method according to the invention may be carried out either discontinuously or continuously. For the discontinuous method the method used for a similar process for providing a coating of polycrystalline silicon carbide on a support and, for example, a method analogous to the one described in U.S. Pat. No. 3,157,541 may be chosen. For the continuous method a process may be chosen analogous to the one described in Appl. Phys. Letters, Vol. 9, No. 1, pages 37–39.

The method according to the invention may be suitably carried out in a continuous manner if the support on which the silicon carbide coating is deposited is a wire or a tape. The support is surrounded by a coating of silicon carbide. In practice the clad wire or tape is dived in pieces of the desired length. The support wire or tape may be used as an electrode; wire or tape of tungsten or carbon are suitable for this purpose and molybdenum to a slightly lesser extent because these materials are electrically conducting and correspond to silicon carbide as regards their behaviour of thermal expansion. One or more other electrodes may be provided, for example, in a manner as described in U.S. Pat. No. 3,047,439. An alloy of gold and tantalum is used for this purpose.

It has been found that suitable electrodes may alternatively be provided in a different manner. To this end the support clad with the silicon carbide coating—after having been provided in a first reaction space in a continuous process—is introduced into a second reaction space whose form is analogous to the first space in which by pyrolysis a thin coating of metal, for example, tungsten or molybdenum or carbon is provided on the hot wire clad with a coating of SiC.

In this manner, for example, a coating of tungsten (sheath) of a thickness of 50 μm is provided at an exposure period of 2 minutes by pyrolysis of $WF_6$ at 800° C. wire temperature from a gas mixture of 75% by volume of hydrogen and 25% by volume of $WF_6$. The gas supply rate was 500 cubic cm per minute.

In a corresponding manner a molybdenum coating (sheath) of a thickness of 25 μm was provided in an other case. Wire temperature 800° C.; exposure period 2 minutes; gas mixture 90% by volume of $H_2$ and 10% by volume of $MoF_6$. Gas supply rate 500 cubic cm per minute.

A carbon coating (sheath) was provided by pyrolysis of propane (pressure 100 Torr). Wire temperature 1250° C.; exposure period 30 minutes. Coating thickness 7 μm. Gas supply rate 10 l/min.

At the areas where no metal is desired on the resistors this metal can be removed, for example, by burning off, spark erosion, grinding or etching.

For the construction of the electric resistors to be manufactured from the products obtained the support may or may not be used as an electrode. Lead-in or lead-out wires may be provided in manners known for example, by soldering with an Au-Ta-alloy or, for example, by spot welding. The latter is especially suitable for cases where a metal support is used as an internal electrode.

An embodiment of the method according to the invention is the one in which not one but two or more and preferably two parallel supports are passed through the reaction space in which the silicon carbide coating is provided on these supports. Of the resultant product electric resistors can be manufactured after it has been divided in the desired lengths and without the provision of further electrodes by providing lead-in or lead-out wires, for example, by means of spot welding on the different separated electrodes of silicon carbide formed in the method.

A resistor as shown in FIG. 2 was manufactured by suspending two parallel wires separated by about 0.3 nm in a quartz bed jar and coating them by the method d described on page 10. The coating on each wire was allowed to grow until both coatings grew together. Slices were then cut from the resultant body, perpendicular to the wires and by spot welding conducting wires were connected to the coated wires.

What is claimed is:

1. A method of manufacturing a resistance body for an electric resistor, said resistance body consisting of p-type doped pyrolytic polycrystalline cubic silicon carbide, said method consisting essentially of passing a mixture of a gaseous silicon compound, a gaseous carbon compound or a gaseous silicon carbon compound and a gaseous compound of a doping element, said doping element being only a p-type doping element, along a support heated to the pyrolysis temperatures of said gaseous compounds to thereby cause pyrolysis of said gaseous compounds and cause deposition on said support only of a compact coating of p-doped polycrystalline cubic silicon carbide on said support.

2. A method as claimed in claim 1, characterized in that a conducting or non-conducting wire or tape-shaped support is used.

3. A method as claimed in claim 2, characterized in that a wire consisting of an element of the group consisting of tungsten, carbon and molybdenum is used as a support.

4. A method as claimed in claim 3, characterized in that a compound of boron is used as a compound of a doping element.

5. A method as claimed in claim 3, characterized in that a compound of aluminum is used as a compound of a doping element.

6. A method as claimed in claim 4, characterized in that the compound of boron at a pyrolysis temperature between about 1200° and about 1350° C. is used in a concentration in the range between $5.10^{-3}$% by volume and $7.10^{-1}$% by volume of the pyrolysis gas.

7. A method as claimed in claim 4 characterized in that the compound of boron at a pyrolysis temperature between about 1350° C. and about 1500° C. is used in a concentration in the range between 2 $10^{-3}$% by volume to $5.10^{-2}$% by volume of the pyrolysis gas.

8. A method as claimed in claim 5, characterized in that the compound of aluminum at a pyrolysis temperature of between about 1200° and 1500° C. is used in a concentration in the range between 0.003% by volume and 0 0.03% by volume of the pyrolysis gas.

* * * * *

UNITED STATES PATENT AND TRADEMARK OFFICE

CERTIFICATE OF CORRECTION

PATENT NO. : 4,208,449

DATED : June 17, 1980

INVENTOR(S) : Wilhelmus F. Knippenberg et al.

It is certified that error appears in the above—identified patent and that said Letters Patent is hereby corrected as shown below:

Column 8, line 6, After "between" delete " $210^{-3}$%"

and insert -- $2.10^{-3}$% --.

Signed and Sealed this

*Third* Day of *February 1981*

[SEAL]

*Attest:*

RENE D. TEGTMEYER

*Attesting Officer*

*Acting Commissioner of Patents and Trademarks*